US006981286B2

(12) United States Patent
Sallick

(10) Patent No.: US 6,981,286 B2
(45) Date of Patent: Jan. 3, 2006

(54) HIDDEN MOUNTING OF WATER VALVE BODY AND HEADWORKS ASSEMBLY

(75) Inventor: Robert J. Sallick, Danbury, CT (US)

(73) Assignee: Waterworks, Inc., Danbury, CT (US)

( * ) Notice: Subject to any disclaimer, the term of this patent is extended or adjusted under 35 U.S.C. 154(b) by 0 days.

(21) Appl. No.: 10/442,763

(22) Filed: May 21, 2003

(65) Prior Publication Data

US 2004/0231048 A1 Nov. 25, 2004

(51) Int. Cl.
*E03C 1/042* (2006.01)

(52) U.S. Cl. ..... 4/675; 4/695; 137/359

(58) Field of Classification Search ..... 4/675, 4/676, 678, 695; 137/359, 360, 801
See application file for complete search history.

(56) References Cited

U.S. PATENT DOCUMENTS 1,619,748 A * 3/1927 Muend ..... 137/360
4,463,460 A * 8/1984 Arnold et al. ..... 4/678
5,535,776 A * 7/1996 Kingman ..... 137/359
5,669,407 A * 9/1997 Bailey ..... 137/359

* cited by examiner

*Primary Examiner*—Robert M. Fetsuga
(74) *Attorney, Agent, or Firm*—Goodwin Procter, LLP

(57) ABSTRACT

A water valve assembly is disclosed for mounting with respect to a mounting surface, the water valve assembly including a water valve body having external threads on the exterior thereof and internal threads to receive a headworks and the headworks; the improvement comprising: a handle trim connecter; the handle trim connecter having a hollow cylindrical lower portion and an upper flange portion; the hollow cylindrical lower portion having internal threads to mate with the external threads on the threaded portion and the upper flange portion for engaging the mounting surface. In one embodiment the improvement further comprises a hollow cylindrical spacer member mounted surrounding the handle trim connecter below the upper flange portion.

18 Claims, 3 Drawing Sheets

HIDDEN MOUNTING OF WATER VALVE BODY AND HEADWORKS ASSEMBLY

FIELD OF THE INVENTION

This invention relates to the mounting of a water valve body and headworks assembly with respect to a mounting surface and particularly to the mounting of a water valve body and headworks assembly with respect to a mounting surface so that the assembly is hidden from view by the mounting surface allowing greater flexibility in the handle design and importantly, in a way which allows the headworks to be replaced from above the mounting surface.

BACKGROUND OF THE INVENTION

Presently, a water valve body and headworks (or cartridge) assembly is mounted with respect to a mounting surface, such as a vanity or sink top, by threads on the outside of the water valve body being secured just above the mounting surface by a locking member which is part of an escutcheon. The headworks engages the mounted water valve body so as to protrude substantially above the mounting surface. A handle is used to both engage and control the headworks and a cover is used below the handle and above the escutcheon to hide the protruding portion of the headworks from view. The need to hide the protruding headworks limits the looks that can be achieved in water valve handle design.

BRIEF DESCRIPTION OF THE INVENTION

In order to over come this limitation of the prior art the present invention contemplates in a water valve assembly for mounting with respect to a mounting surface, the water valve assembly including a water valve body having external threads on the exterior thereof and internal threads to receive a headworks and the headworks; the improvement comprising a handle trim connecter; the handle trim connecter having a hollow cylindrical lower portion and an upper flange portion; the hollow cylindrical lower portion having internal threads to mate with the external threads on the threaded portion and the upper flange portion for engaging the mounting surface. In one embodiment the improvement further comprises a hollow cylindrical spacer member mounted surrounding the handle trim connecter below the upper flange portion. The hollow cylindrical spacer member could be plastic, and is used when the mounting surface is on a deck that is less than 1.5 inches thick.

In a further embodiment the water valve assembly is positioned substantially below the mounting surface and further comprises an escutcheon having a descending threaded portion; said escutcheon for mounting on the mounting surface to cover the upper flange portion; and second internal threads internal to the upper flange portion for mating with the descending threaded portion of the escutcheon.

DESCRIPTION OF THE DRAWINGS

The invention will be described in the following detailed description that will be referring to the drawings as follows.

DETAILED DESCRIPTION OF THE INVENTION

Figure 1:
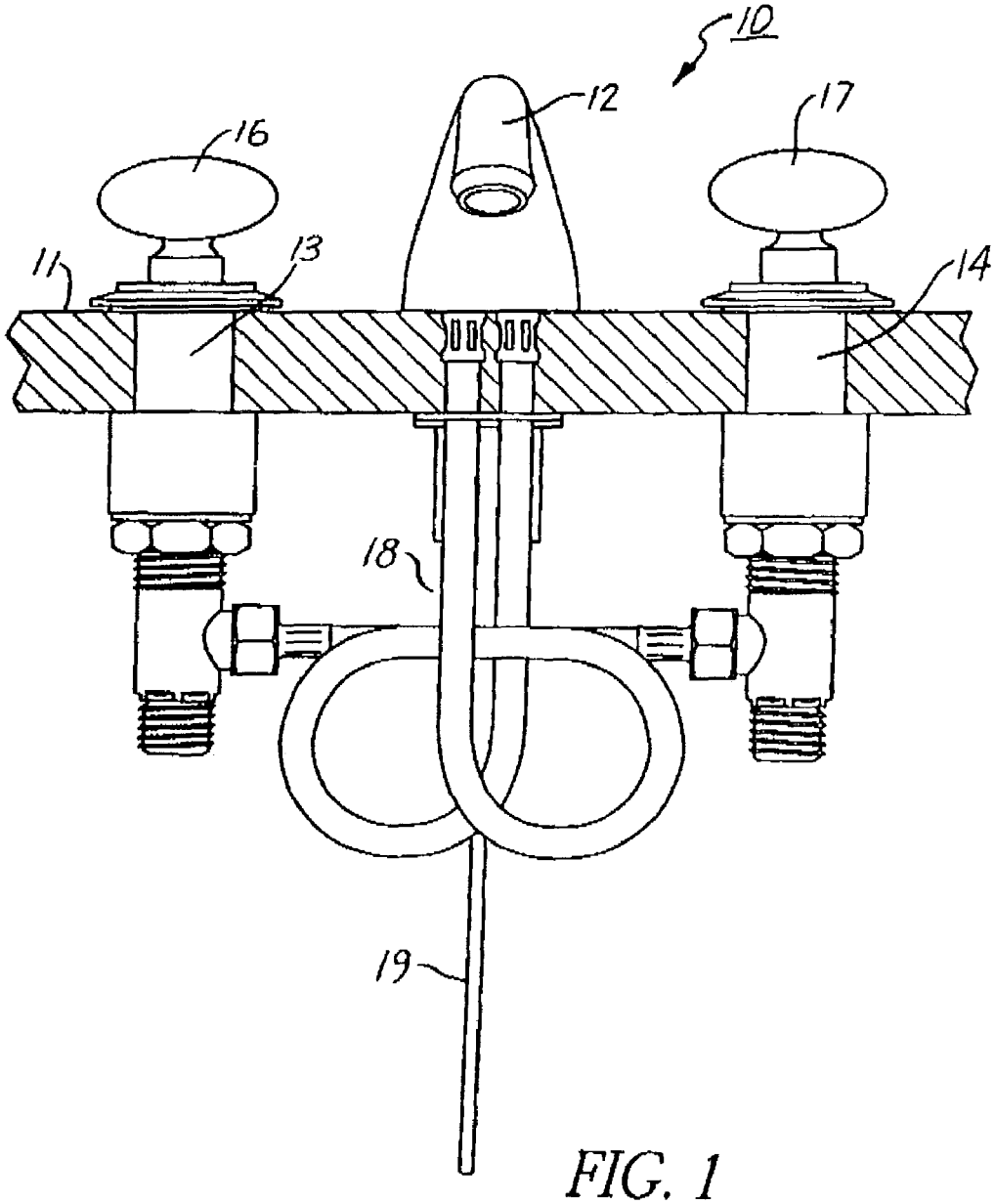
FIG. 1 is a front elevation view showing a mounted faucet assembly including a pair of water valve body and headworks assemblies in accordance with the teachings of this invention.

Referring now to FIG. 1, we see a faucet assembly 10 mounted on a lavatory surface 11 such as found on a sink or vanity. The faucet assembly 10 includes three main elements; a spout 12 and a pair of water valve body and headworks assemblies 13 and 14. The water valve body and headworks assemblies 13 and 14 are each controlled by a handle 16 and 17 which could be made of crystal. The handle 16 and 17 can be made of any traditional handle material but is shown here as transparent glass to emphasize the flexibility in handle design afforded by the water valve body and headworks valve assembly of this invention.

There is also shown in FIG. 1 the traditional plumbing 18 to connect the water valve and headworks valve assemblies 13 and 14 to the spout 12 and a rod 19 for controlling a drain.

Figure 2:
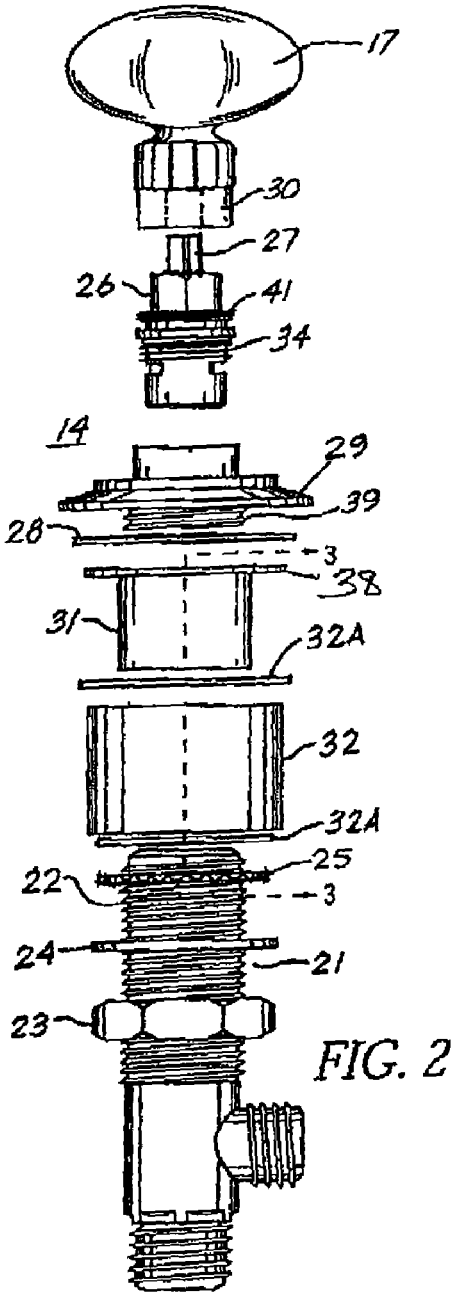
FIG. 2 is an exploded view of the water valve body and headworks assembly of this invention to show the parts thereof.

Referring now to FIG. 2, we see an exploded view of the water valve body and headworks assembly 14 together with the handle 17. As can be seen, the water valve and headworks assembly 14 includes a water valve body 21 having external threads 22, locking nuts 23 and 25 engaging the threads 22 and a metal washer 24 which in operation is secured by the locking nut 23 and a gaskets 32*a*. The water valve body and headworks assembly 14 also includes a headworks 26 having a splined upper portion 27 thereon.

Figure 4:
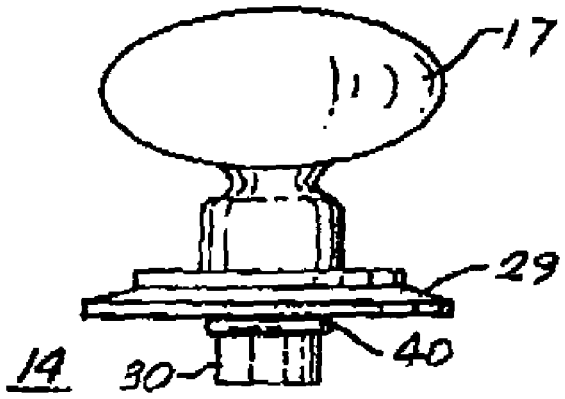
FIG. 4 is a front elevation view showing the handle, stem connecter and escutcheon combined as an assembled unit by a C Clamp.

FIG. 2 also shows the handle 17, an escutcheon 29, a handle trim connector 31 a seal 28 and a plastic spacer 32. The handle 17, escutcheon 29, handle trim connector 31 seal 28 and plastic spacer 32 are especially designed for use in the present invention. The handle 17 is attached to a stem connecter 30 by, for example, epoxy when the handle 17 is crystal. In accordance with this invention the handle 17, the stem connecter 30 and the escutcheon 29 are secured together by a C clamp 40 (see FIG. 4) to act as a single unit to prevent an installer from spacing them improperly. The lower portion of the stem connecter 30 has a female spline to mate with the upper splined portion 27 of the headworks 26. The escutcheon 29 is secured around the stem connecter 30 touching the lower surface of the handle 17 so that a space cannot be seen due to improper installation.

Figure 3:
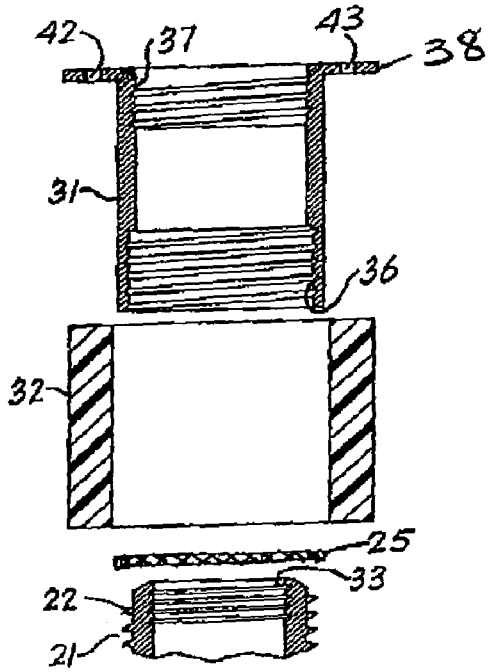
FIG. 3 is a sectional view along the line 3—3 in FIG. 2 to show the internal configuration of some important elements of this invention.
Figure 5:
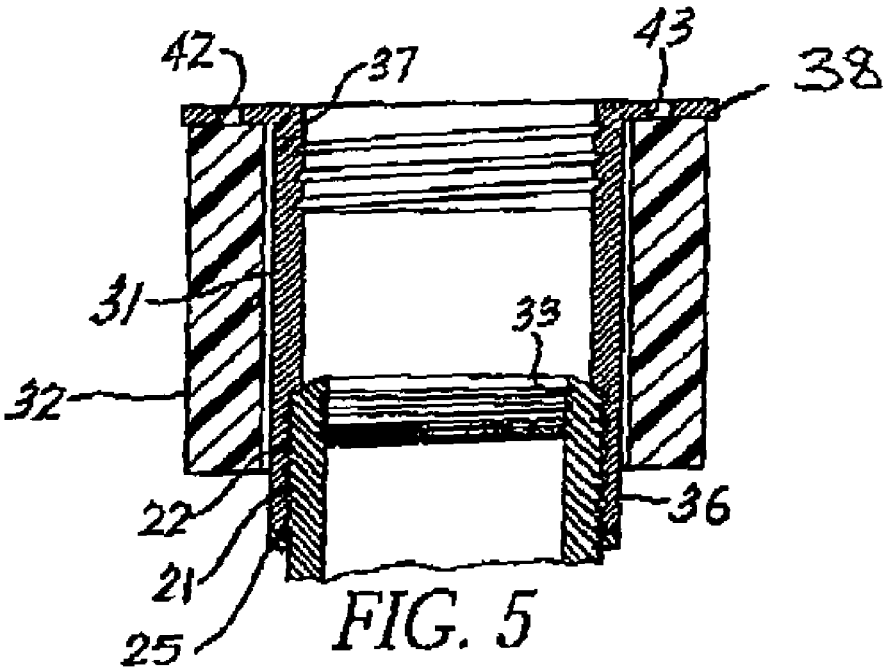
FIG. 5 is a sectional view showing the details of the integration of some important elements of this invention.

Referring now to FIG. 3, we see that the water valve body 21 has internal threads 33 at the upper portion thereof. These threads 33 mate with external threads 34 on the headworks 26 to allow or inhibit the flow of water as is common in known water valves. Referring now to all the FIGs., we see that the handle trim connecter 31 has internal threads 36 on the lower portion thereof terminating a fixed distance from the edge thereof and internal threads 37 on the upper portion thereof terminating a fixed distance from the other edge thereof. The internal threads 36 of the handle trim connecter 31 mate with the threads 22 to position the water valve body and headworks assembly 14 below the top of the lavatory surface 11 (see in particular FIG. 5). If the thickness of the lavatory surface 11 is too small the plastic spacer 32 is used to allow the locking nut 23 to secure the lip 38 of the handle trim connecter 31 against the top of the lavatory surface 11.

Since the water valve body and headworks assembly 14 is now positioned below the top of the lavatory surface 11 the glass handle 17 can be used without a cover and without the water valve body and headworks assembly 14 or portions thereof being visible. The spline upper portion 27 is engaged by the female spline of the stem connecter 30 so that the glass handle can control the water valve body and headworks assembly 14. The escutcheon 29 has descending threads 39 which mate with the internal threads 37 of the handle trim connecter 31. In present water valves a cover is either secured thereto by mating with external threads 41 on the headworks 26 or made part of the escutcheon which mates with external threads 41. In the embodiments of this invention threads 41 are not engaged and can be dispensed with if it can be done economically.

In order to aid in the replacement of a headworks such as headworks 26 from above the mounting surface 11 several design features have been incorporated into the water valve body and headworks assembly 14 of this invention. The lock nut 25 is provided to inhibit the handle trim connector 31 from unthreading from the water valve body 21 when a torque is applied to remove the headworks 26 from its position in the water valve body and headworks assembly 14. A pair of holes 42 and 43 are provided in the upper flange of the handle trim connector 31, see FIG. 3, to enable the use of a spanner wrench to also help stabilize the handle trim connector 31 when the torque is applied.

In the preferred embodiment of this invention the dimensions of the handle trim connector 31 are chosen to allow the use of a 17 mm socket wrench from above the mounting surface 11 to loosen and remove the headworks 26 from the mounted water valve body 21. The outside diameter of the lower portion of the handle trim connector 31 is 33 mm to allow it to fit inside the normal hole size in mounting surfaces 11 in the United States while the outside diameter of the flange is 45 mm to insure that the handle trim connector 31 does not slip through such normal hole size. The inside diameter of the handle trim connector 31 is 25 mm to allow the 17 mm socket wrench to fit inside and be moved as necessary.

While this invention has been described with respect to a particular embodiment thereof numerous others can be envisioned that will fall within the sprit and scope thereof.

What is claimed is:

1. In combination: a mounting surface and a water valve body and headworks assembly; said water valve body and headworks assembly mounted with respect to said mounting surface, said water valve body and headworks assembly including a headworks having external threads on the exterior thereof and a water valve body having external threads on the exterior thereof and internal threads at an upper portion thereof for mating with said external threads of said headworks; the improvement comprising:

a handle trim connecter;

said handle trim connecter having a hollow cylindrical lower portion and an upper flange portion;

said upper flange portion for engaging above said mounting surface;

said hollow cylindrical lower portion having internal threads for mating with said external threads on the exterior of said water valve body to position said water valve body and headworks entirely below said mounting surface.

2. In the water valve assembly as set forth in claim 1; the improvement further comprising: a lock nut thread to said external threads on said threaded portion to inhibit said handle trim connecter unthreading from the water valve body when a torque is applied to remove the headworks from its position in the water valve body and headworks assembly.

3. In the water valve assembly as set forth in claim 1; the improvement further comprising a hollow cylindrical spacer member mounted surrounding said handle trim connecter below said upper flange portion.

4. In the water valve assembly as set forth in claim 3; the improvement further comprising: said hollow cylindrical spacer member being plastic.

5. In the water valve assembly as set forth in claim 1 wherein said headworks is positioned substantially below said mounting surface.

6. In the water valve assembly as set forth in claim 5; the improvement further comprising: a lock nut thread to said external threads on said threaded portion to inhibit said handle trim connecter unthreading from the water valve body when a torque is applied to remove the headworks from its position in the water valve body and headworks assembly.

7. In the water valve assembly as set forth in claim 5; the improvement further comprising: a hollow cylindrical spacer member mounted surrounding said handle trim connecter below said upper flange portion.

8. In the water valve assembly as set forth in claim 7; the improvement further comprising: said hollow cylindrical spacer member being plastic.

9. In the water valve assembly as set forth in claim 1; the improvement further comprising:

an escutcheon having a descending threaded portion for mounting on said mounting surface to cover said upper flange portion; and second internal threads internal to said upper flange portion for mating with said descending threaded portion of said escutcheon.

10. In the water valve assembly as set forth in claim 9; the improvement further comprising: a hollow cylindrical spacer member mounted surrounding said handle trim connecter below said upper flange portion.

11. In the water valve assembly as set forth in claim 10; the improvement further comprising: said hollow cylindrical spacer member being plastic.

12. In the water valve assembly as set forth in claim 9 said headworks is positioned substantially below said mounting surface.

13. In the water valve assembly as set forth in claim 12; the improvement further comprising: a hollow cylindrical spacer member mounted surrounding said handle trim connecter below said upper flange portion.

14. In the water valve assembly as set forth in claim 13; the improvement further comprising: said hollow cylindrical spacer member being plastic.

15. In the water valve assembly as set forth in claim 1; the improvement further comprising:

an escutcheon assembly having a top side and a bottom side and a descending threaded portion extending from said bottom side for mounting on said mounting surface to cover said upper flange portion, a handle passing there through from said upper side of said escutcheon to said bottom side thereof and a stem connecter attached to said handle on said bottom thereof; said stem connecter having a spline therein;

second internal threads internal to said upper flange portion for mating with said descending threaded portion of said escutcheon; and a splined upper portion of said headworks; said splined upper portion of said headworks mating with said stem connecter spline.

16. In combination:

a mounting surface and a water valve body and headworks assembly; said water valve body and headworks assembly mounted with respect to said mounting surface; said water valve body and headworks assembly including headworks having external threads on the exterior thereof and a water valve body having external threads on the exterior thereof and internal threads at an upper portion thereof for mating with said external threads of said headworks; the improvement comprising:

a handle trim connecter;

said handle trim connecter having a hollow cylindrical lower portion and an upper flange portion;

said upper flange portion for engaging above said mounting surface;

said hollow cylindrical lower portion having internal threads for mating with said external threads on the exterior of said water valve body to position said water valve body and headworks below said mounting surface without said water valve body and headworks or portions thereof being visible.

17. In the water valve assembly as set forth in claim 16; the improvement further comprising:

an escutcheon assembly having a top side and a bottom side and a descending threaded portion extending from said bottom side for mounting on said mounting surface to cover said upper flange portion, a handle passing there through from said upper side of said escutcheon to said bottom side thereof and a stem connecter attached to said handle on said bottom thereof; said stem connecter having a spline therein;

second internal threads internal to said upper flange portion for mating with said descending threaded portion of said escutcheon; and a splined upper portion of said headworks; said splined upper portion of said headworks mating with said stem connecter spline.

18. In combination:

a mounting surface;

a water valve body and headworks assembly; said water valve body and headworks assembly mounted with respect to said mounting surface, said water valve body and headworks assembly including a headworks having external threads on the exterior thereof and a water valve body having external threads on the exterior thereof and internal threads at an upper portion thereof for mating with said external threads of said headworks; the improvement comprising:

a handle trim connecter;

said handle trim connecter having a hollow cylindrical lower portion and an upper flange portion;

said upper flange portion for engaging above said mounting surface;

said hollow cylindrical lower portion having internal threads for mating with said external threads on the exterior of said water valve body to position said water valve body and headworks below said mounting surface;

an escutcheon assembly having a top side and a bottom side and a descending threaded portion extending from said bottom side for mounting on said mounting surface to cover said upper flange portion, a handle passing there through from said upper side of said escutcheon to said bottom side thereof and a stem connecter attached to said handle on said bottom thereof; said stem connecter having a spline therein;

second internal threads internal to said upper flange portion for mating with said descending threaded portion of said escutcheon; and a splined upper portion of said headworks; said splined upper portion of said headworks mating with said stem connecter spline.

* * * * *